US009370683B2

(12) United States Patent
Shauli

(10) Patent No.: US 9,370,683 B2
(45) **Date of Patent: *Jun. 21, 2016**

(54) EXERCISE APPARATUS FOR RETROFITTING TO SWIVEL CHAIRS ON CASTORS

(71) Applicant: Chair Trainer Ltd., Kfar Saba (IL)
(72) Inventor: Misha Shauli, Kfar Saba (IL)
(73) Assignee: Chair Trainer Ltd., Kfar Saba (IL)

( * ) Notice: Subject to any disclaimer, the term of this patent is extended or adjusted under 35 U.S.C. 154(b) by 0 days.

This patent is subject to a terminal disclaimer.

(21) Appl. No.: 14/836,378
(22) Filed: Aug. 26, 2015
(65) Prior Publication Data

US 2015/0360072 A1 Dec. 17, 2015

Related U.S. Application Data

(63) Continuation of application No. 13/941,690, filed on Jul. 15, 2013, now Pat. No. 9,149,678, which is a continuation-in-part of application No. 12/598,542, filed as application No. PCT/IL2008/000657 on May 11, 2008, now Pat. No. 8,512,210.

(60) Provisional application No. 60/928,170, filed on May 8, 2007.

(51) Int. Cl.
*A63B 71/00* (2006.01)
*A63B 21/02* (2006.01)
(Continued)

(52) U.S. Cl.
CPC ..... *A63B 21/045* (2013.01); *A47C 9/002* (2013.01); *A63B 21/00069* (2013.01);
(Continued)

(58) Field of Classification Search
CPC ..... A63B 21/0004; A63B 21/00178; A63B 21/02; A63B 21/023; A63B 21/025; A63B 21/04; A63B 21/0407; A63B 21/0435; A63B 21/0442; A63B 21/045; A63B 21/0455; A63B 21/15; A63B 21/151; A63B 21/153; A63B 21/16; A63B 21/1609; A63B 21/40; A63B 21/4001; A63B 21/4011; A63B 21/4015; A63B 21/4033; A63B 21/4034; A63B 22/20; A63B 23/03525; A63B 23/04; A63B 23/0405; A47C 9/002
USPC ..... 482/8, 121–139; 297/84, 85 C, 297/271.1–271.4, 423.12
See application file for complete search history.

(56) References Cited

U.S. PATENT DOCUMENTS 3,754,547 A * 8/1973 Walker ..... A61H 1/02 482/121
4,767,160 A * 8/1988 Mengshoel ..... A47C 7/52 248/188.7

(Continued)

FOREIGN PATENT DOCUMENTS

WO 94/04228 A2 3/1994
WO 2007/148333 A2 12/2007

OTHER PUBLICATIONS

International Search Report for PCT/IL2008/000657 (1 page).

*Primary Examiner* — Oren Ginsberg
*Assistant Examiner* — Joshua Lee
(74) *Attorney, Agent, or Firm* — Brown Rudnick LLP

(57) ABSTRACT

A limb-exercising apparatus for coupling to a swivel chair includes a plurality of chair legs that define a chair leg base with an underside. The limb-exercising apparatus has a rigid framework that includes at least one chair coupler that couples the rigid framework with the underside, such that the rigid framework is disposed underneath the chair leg base and a relative movement between the rigid framework and the swivel chair is minimal. At least one limb-exercising unit is coupled with the rigid framework and is operative to provide movement exercise for at least one muscle group of a user's body. A force resistor is coupled with the rigid framework and with the at least one limb-exercising unit. The force resistor provides resistance to movement of the at least one limb-exercising unit. A cable couples between the at least one limb-exercising unit and the force resistor.

12 Claims, 15 Drawing Sheets

(51) Int. Cl.

| | |
|---|---|
| ***A63B 21/045*** | (2006.01) |
| ***A47C 9/00*** | (2006.01) |
| ***A63B 21/04*** | (2006.01) |
| ***A63B 21/00*** | (2006.01) |
| ***A63B 22/20*** | (2006.01) |
| ***A63B 23/035*** | (2006.01) |
| ***A63B 23/04*** | (2006.01) |

(52) U.S. Cl.

CPC ..... *A63B 21/023* (2013.01); *A63B 21/0442* (2013.01); *A63B 21/0455* (2013.01); *A63B 21/153* (2013.01); *A63B 21/1609* (2015.10); *A63B 21/4034* (2015.10); *A63B 21/4045* (2015.10); *A63B 22/20* (2013.01); *A63B 23/03525* (2013.01); *A63B 23/0405* (2013.01); *A63B 2209/10* (2013.01)

(56) References Cited

U.S. PATENT DOCUMENTS 4,913,423 A * 4/1990 Farran ..... A63B 21/154 297/217.1
5,158,074 A * 10/1992 Grellas ..... A61H 1/0274 297/188.21
5,643,143 A * 7/1997 Burak ..... A63B 1/0009 482/54
5,690,594 A * 11/1997 Mankovitz ..... A63B 21/1609 482/121
5,807,212 A 9/1998 Nelson
5,839,995 A * 11/1998 Chen ..... A63B 22/001 280/304.1
6,334,624 B1 * 1/2002 Giglio ..... A63B 21/0087 280/304.1
6,440,046 B1 8/2002 Tholkes
6,648,358 B2 * 11/2003 Catanescu ..... A61G 5/10 280/304.1
6,716,143 B1 * 4/2004 Martin ..... A63B 22/001 482/62
7,150,070 B2 12/2006 Donakowski
7,361,127 B2 4/2008 Tremayne
7,497,812 B2 3/2009 Neff et al.
7,537,553 B2 * 5/2009 Mongelluzzo ..... A47C 9/002 482/121
7,635,323 B2 12/2009 Halbridge
7,648,447 B2 1/2010 Andre
2004/0053756 A1 * 3/2004 Tremayne ..... A63B 21/055 482/126
2004/0142797 A1 7/2004 Andre
2005/0143235 A1 * 6/2005 Park ..... A63B 21/055 482/142
2006/0258517 A1 11/2006 Ashley
2006/0276311 A1 * 12/2006 Martin ..... A63B 21/00181 482/92
2008/0039301 A1 * 2/2008 Halbridge ..... A63B 21/026 482/121
2008/0081748 A1 * 4/2008 Knapp ..... A63B 23/1209 482/130
2009/0233773 A1 * 9/2009 Cardey ..... A63B 21/0552 482/121

* cited by examiner

EXERCISE APPARATUS FOR RETROFITTING TO SWIVEL CHAIRS ON CASTORS

REFERENCE TO RELATED APPLICATIONS

This application is a continuation of, and claims priority to U.S. application Ser. No. 13/941,690, filed Jul. 15, 2013, which in turn is a continuation-in-part of U.S. Ser. No. 12/598,542 filed Oct. 2, 2009 now issued as U.S. Pat. No. 8,512,210 that claims priority of PCT/IL2008/000657 filed May 11, 2008, which in turn claims priority of U.S. Ser. No. 60/928,170 filed May 8, 2007.

FIELD OF THE DISCLOSED TECHNIQUE

The disclosed technique relates to exercise apparatuses in general, and to limb-exercising apparatuses for retrofitting to swivel chairs on castors, in particular.

BACKGROUND OF THE DISCLOSED TECHNIQUE

Numerous studies have shown that continuous sitting for prolonged periods (i.e., more than three hours at a time) may increase the risk of developing certain diseases (e.g., diabetes, heart disease, liver disease) even for those individuals who are engaged and practice daily physical activity. With an ever increasing number of modern-day workplaces (i.e., desk jobs) than before, individuals are less physically active during certain hours of the day. Such periods of relative physical inactivity affects the body's metabolism such that there is deceased blood circulation, as well as adverse blood sugar and triglyceride levels, which in turn affect the body's mechanism associated with the regulation and storage of body fat. Furthermore, studies have also shown that periods of prolonged sitting may contribute to poor posture, and may cause accumulated mechanical trauma to the joints (e.g., knees, ankles, pelvis, back, neck) as well as to the spine. Various approaches have been proposed that claim to address this sedentariness and thus aim to lower one's risks involved in continuous and prolonged sitting while working.

Exercise apparatuses, in general, for use with office chairs are known in the art. U.S. Pat. No. 7,648,447 B2 issued to Andre and entitled "Leg exercise device for use with an office chair" is directed to an exercise device that is constructed to be connected to the vertical seat support of the office chair. The device includes a leg exercise mechanism and a rigid connection mechanism. The leg exercise mechanism, which is a pedaling mechanism, includes opposite rotating pedals, drive housing, and a tension control knob. The rigid connection mechanism includes a first lateral arm, a rectangular brace, a flange, an angled second arm, a penannular collar, and a tightening pin. The pedaling mechanism extends laterally from the drive housing. The first lateral arm is movably connected to the rectangular brace. The rectangular brace is used for adjusting the lateral distance of the pedaling mechanism from the office chair. The leg exercise device is secured to the office chair such that the pedaling mechanism is positioned in front of a user of the leg exercise device. The collar is secured to the vertical seat support of the office chair by inserting the vertical seat support through the open portion of the penannular collar and then tightening the tightening pin against the vertical seat support. Using the leg exercise device is accomplished by sitting on the office chair seat and pedaling the pedaling mechanism.

SUMMARY OF THE DISCLOSED TECHNIQUE

It is an object of the disclosed technique to provide a novel apparatus for enabling physical exercise by a user, who sits on a swivel chair, in an office setting, which overcomes the disadvantages of the prior art.

According to the disclosed technique, there is thus provided a limb-exercising system for coupling (i.e., attaching, retrofitting) to or manufacturing with the swivel chair. The swivel chair typically includes a plurality of chair legs, a plurality of castors, and a plurality of pivotal pins. Each pivotal pin couples a chair leg with a castor, and each pivotal pin extends upwardly across a gap between the castor and the chair leg. The limb-exercising system includes a rigid framework, at least one limb-exercising unit, a force resistor and a cable. The rigid framework includes at least three chair couplers that are each coupled, at least partially circumferentially, with respective one of at least three of the pivotal pins, substantially within the gap, such to allow rotation of the castors, and such that the relative movement between the rigid framework and the swivel chair is minimal. The limb-exercising unit is coupled with the rigid framework. Each limb-exercising unit is operative to provide movement exercise for at least one muscle group of the body of a user. The force resistor is coupled with the rigid framework and with the limb-exercising unit. The force resistor provides resistance to movement of the limb-exercising unit. The cable couples between limb-exercising unit and the force resistor.

According to another aspect of the disclosed technique, there is thus provided a limb-exercising system for coupling (i.e., attaching, retrofitting, etc.) to or manufacturing with the swivel chair by employing at least one chair coupler. The swivel chair includes a plurality of chair legs that define a chair leg base that has an underside. The limb-exercising apparatus includes a rigid framework, at least one limb-exercising unit, a force resistor, and a cable. The rigid framework includes at least one chair coupler that couples the rigid framework with the chair leg base, such that the relative movement between the rigid framework and the swivel chair is minimal. The at least one limb-exercising unit is coupled with the rigid framework. Each limb-exercising unit is operative to provide movement exercise for at least one muscle group of the body of a user. The force resistor is coupled with the rigid framework and with the limb-exercising unit. The force resistor provides resistance to movement of the limb-exercising unit. The cable couples between the limb-exercising unit and the force resistor.

BRIEF DESCRIPTION OF THE DRAWINGS

The disclosed technique will be understood and appreciated more fully from the following detailed description taken in conjunction with the drawings in which.

DETAILED DESCRIPTION OF THE EMBODIMENTS

Figure 1:
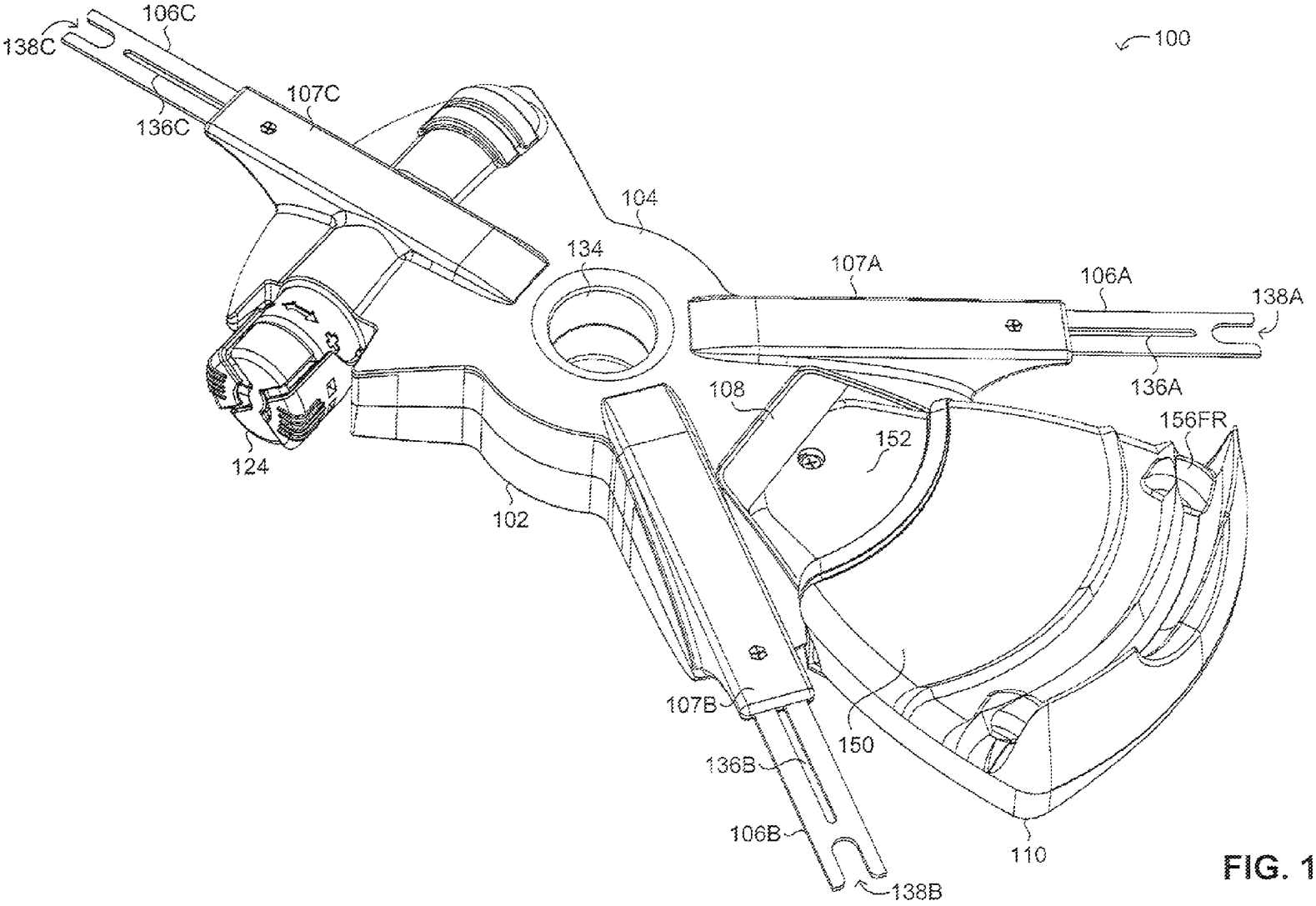
FIG. 1 is a schematic illustration in a perspective top view of a limb-exercising apparatus, constructed and operative according to an embodiment of the disclosed technique.

The disclosed technique overcomes the disadvantages of the prior art by providing a limb-exercising apparatus for retrofitting to existing swivel chairs on castors such that the mobility of the swivel chair is not compromised. The limb-exercising apparatus is constructed to be easily mounted to typically standard multi-legged swivel chair on castors, and may be dismounted from the swivel chair, when required. The limb-exercising apparatus provides a user who is seated in a retrofitted swivel chair, with the ability to concurrently perform his or her occupation (e.g., desk job) while exercising, without producing substantial machine noise in the process. The limb-exercising apparatus provides hands-free operation such that it does not constrain the user in carrying out desk jobs that typically entail for example, computer use (e.g., via keyboard, mouse, hand-gestures) the handling of documents, reading, speaking over the phone, "hand-talking", and the like. When correctly mounted on the swivel chair (and correctly used), the limb-exercising apparatus is constructed and operative to minimize potential occupational safety hazards associated with its use (i.e., in comparison with prior art exercising apparatuses that employ weights), such as for example, the prevention of tipping over of the user, as well as easy disengagement when there is a need for fast evacuation of the premises during emergencies (e.g., fires, earthquakes).

In essence, the limb-exercising apparatus is constructed and operative for coupling to typically standard existing swivel chairs that include a plurality of chair legs defining a chair leg base that has an underside. The limb-exercising apparatus includes a rigid framework, at least one limb-exercising unit, a force resistor, and a cable. The rigid framework includes at least one chair coupler that couples the rigid framework with the chair leg base (i.e., so that the limb-exercising apparatus is disposed underneath the chair leg base), such that the relative movement between the rigid framework and the swivel chair is minimal. The rigid framework is coupled with the limb-exercising unit and with the force resistor, which in turn is coupled with the limb-exercising unit via the cable. The limb-exercising unit is operative to provide movement exercise for at least one muscle group of the body of a user. In accordance with another embodiment, the rigid framework is operative to be coupled with the pivotal pins of the swivel chair. Each pivotal pin extends upwardly across a gap between the castor and the chair leg, such that the pivotal pin, in effect couples a chair leg with a castor. The rigid framework includes at least three chair couplers that are each respectively coupled, at least partially circumferentially, with at least one of at least three pivotal pins, substantially within these gaps. The gaps allow free rotation of the castors and thus multi-directional movement of swivel chair upon the ground that supports it. The chair couplers are constructed and operative to couple the rigid framework with the swivel chair such that the relative movement between the rigid framework and the swivel chair is minimal and such to further allow free rotation of the castors on the ground. The limb-exercising apparatus and swivel chair may further be manufactured as a single unit (e.g., as a mass-produced, factory-made item), such that for example, at least part (e.g., the outer covering) of the limb-exercising apparatus is incorporated into the structure of swivel chair.

The term "force resistor" used herein throughout the detailed description and the claims refers to an apparatus that at least partially resists force applied thereto in at least one component direction that is opposite to the direction of the applied force. Force resistor may be, for example, implemented as a helical torsion spring, a torsion spring, a torsion bar, a double torsion spring, a geared resistance mechanism, an apparatus having multiply distinct cooperating components that provide resistance in response to applied motion to at least one of the distinct cooperating components, and the like. The terms "underside" and "underneath" used herein throughout the detailed description and the claims in the context that relates to swivel chair, refers to any part of the swivel chair that is disposed between the chair leg base (included) and the ground upon which the swivel chair is supported.

Figure 2:
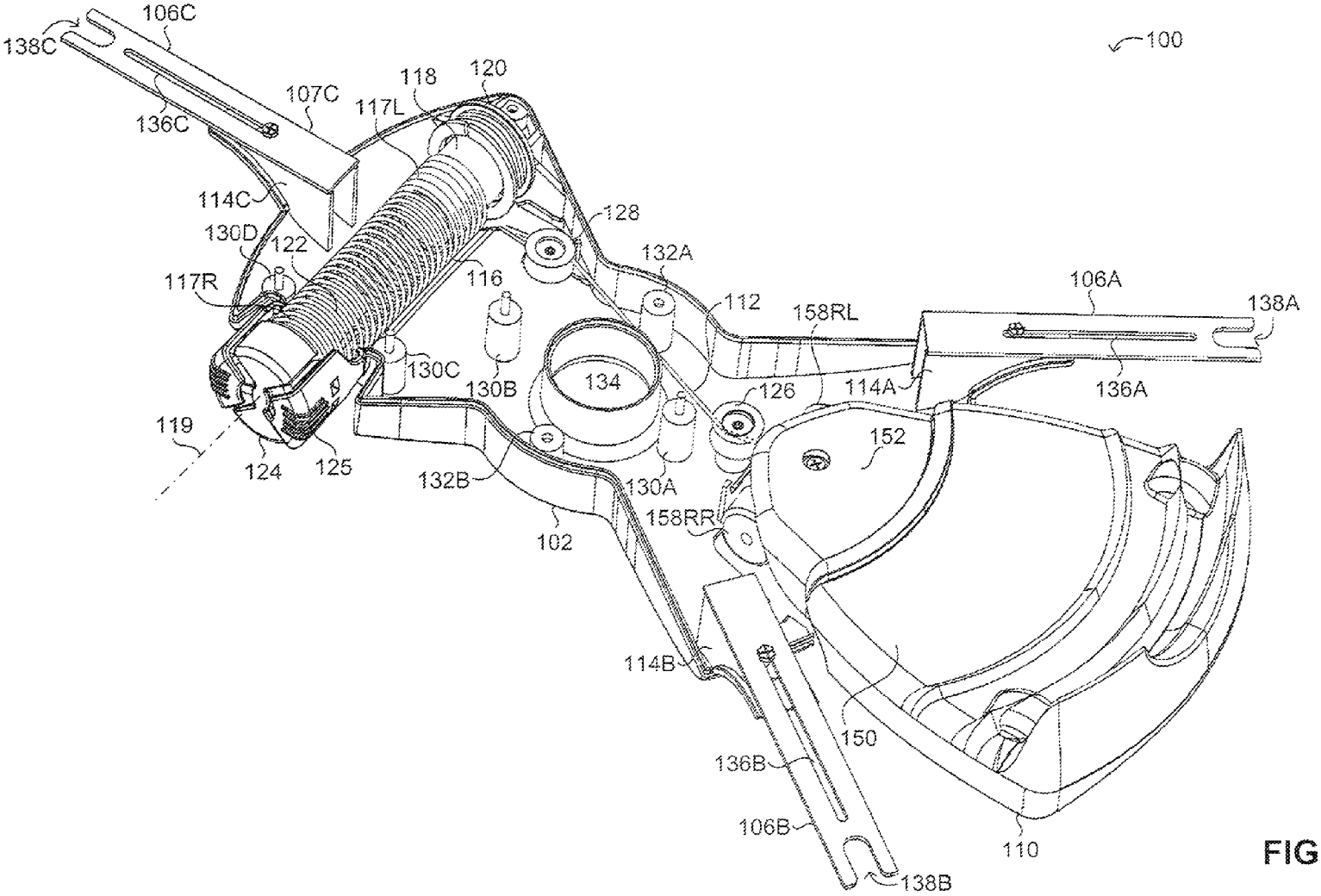
FIG. 2 is a schematic illustration in a perspective top view of the limb-exercising apparatus of FIG. 1 having a top cover removed to reveal internal components.

Reference is now made to FIGS. 1 and 2. FIG. 1 is a schematic illustration in a perspective top view of a limb-exercising apparatus, generally referenced 100, constructed and operative according to an embodiment of the disclosed technique. FIG. 2 is a schematic illustration in a perspective top view of the limb-exercising apparatus of FIG. 1 having a top cover removed to reveal internal components. Limb-exercising apparatus 100 (also denoted herein interchangeably as "exercising apparatus") includes a rigid framework 102, a top cover 104 (FIG. 1), a plurality of chair couplers 106A, 106B, 106C, a plurality of elongated guides 107A, 107B and 107C, a hinged ascending and descending cart ramp 108 (FIG. 1), an extendable and retractable cart 110, and a cable 112. FIGS. 1 and 2 illustrate extendable and retractable cart 110 in a retracted position. Rigid framework 102 includes a plurality of chair coupler supports 114A, 114B, 114C, a force resistor (i.e., implemented herein as helical torsion spring 116), an internal spring shaft 118, a flanged spool 120, an internal spring tensioning shaft 122, a tension adjuster 124, a front pulley 126, a rear pulley 128, a plurality of male snap fasteners 130A, 130B, 130C, 130D, and a plurality of female snap fasteners 132A, 132B. Rigid framework 102 and top cover 104 both include a circular through-hole 134. Chair couplers 106A, 106B, and 106C each include respective elongated slots 136A, 136B, 136C, as well as, at their respective distal ends, U-shaped notches 138A, 138B, and 138C. Helical torsion spring 116 includes two extremities, denoted by 117R and 117L (FIG. 2). Cable 112 couples between extendable and retractable cart 110 and helical torsion spring 116. Cable 112 is a cord characterized by possessing both flexibility and a relatively high tensile strength (e.g., wire rope composed of laid steel strands), which may be either bare or sheathed (e.g., by a covering such as vinyl). One extremity of cable 112 is coupled with flanged spool 120 whilst the other extremity is coupled with extendable and retractable cart 110. In particular, cable 112 extends (at least in part) along an internal tortuous path of framework 102 so to engage rear pulley 128 and front pulley 126. Front and rear pulleys 126 and 128 are operative to support both movement and guiding of cable 112 along at least part of its length. Chair couplers 106A, 106B, and 106C are extendable-retractable in sliding manner at least partially within and along respective elongated guides 107A, 107B, and 107C, as constrained by the longitudinal extend of respective elongated slots 136A, 136B, and 136C.

Internal spring shaft 118 and internal spring tensioning shaft 122 are each coupled to respective opposite extremities 117L and 117R of helical torsion spring 116. In particular, helical torsion spring 116 is coiled, along at least part of its length (including extremity 117L) around internal spring shaft 118 so as to substantially allow for torque to be transmitted therebetween. Helical torsion spring 116 defines a rotation/twisting axis 119 about which helical torsion spring 116 twists (and untwists). Rotation of internal spring shaft 118 produces a corresponding rotation (twisting/untwisting) of helical torsion spring 116 about twisting axis 119, and vice-versa. Flanged spool 120 is concentrically mounted and mechanically coupled (e.g., rigidly) to internal spring shaft 118 such to allow torque to be substantially transmitted therebetween. Rotation of flanged spool 120 about rotation axis 119 produces a corresponding rotation of internal spring shaft 118, and vice-versa. Flanged spool 120 is generally cylindrical in shape, rigidly and coaxially mounted on outer periphery of internal spring shaft 118 via a bearing (e.g., a ball bearing, not shown). Flanged spool 120 is operative to enable winding and unwinding of cable 112 circumferentially thereon. Internal spring shaft 118 and flanged spool 120 may be manufactured as a single unit. Helical torsion spring 116, at extremity 117R, is coiled, along at least part of its length, around internal spring tensioning shaft 122. Rotation of internal spring tensioning shaft 122 about rotation axis 119 produces a corresponding rotation (twisting/untwisting) of helical torsion spring 116. Tension adjuster 124 is coupled with internal spring tensioning shaft 122. Tension adjuster 124, which is rotatable with respect to rotation axis 119, includes a locking mechanism 125 for locking the angular position of extremity 117R with respect to the angular position of extremity 117L of helical torsion spring 116. The relative difference in angular positions between extremities 117R and 117L determine how much helical torsion spring 116 is twisted (i.e., with respect to its untwisted state) and thus the amount of mechanical energy stored therein.

Chair couplers 106A, 106B, 106C are coupled at different (angular) positions with respect to framework 102 via respective chair coupler supports 114A, 114B, 114C (i.e., typically substantially parallel with the longitudinal extend of framework 102). Chair couplers 106A, 106B, 106C are constructed and operative to be each independently fixatedly adjustable (e.g., via screws) along the lengths of respective elongated slots 136A, 136B, 136C such so enable varying outwardly projecting lengths with respect to framework 102. In other words, chair couplers 106A, 106B, and 106C are length-wise independently adjustable. Male snap fasteners 130A, 130B, 130C, and 130D and female snap fasteners 132A and 1328 of framework 102 are operative to engage and interlock with corresponding reciprocal (i.e., and complementary) members (i.e., male-female, female-male) snap fasteners located on the underside of top cover 104 (not shown), thereby securing top cover 104 to framework 102, as depicted in FIG. 1.

According to the present embodiment of the disclosed technique, the coupling of framework 102 of limb-exercising apparatus 100 to the underside an office swivel chair is accomplished by the engagement of U-shaped notches 138A, 138B, and 138C with respective vertical pivotal pins of the swivel chair, as will be described in detail hereinbelow. Extendable and retractable cart 110 is generally a limb-exercising unit (i.e., typically the legs of a user), that could be interchanged with other types of limb-exercising units (not shown). Helical torsion spring 116 is a force resistor that provides resistance to exercise movements produced by the user, the specifics of which will be described in detail hereinbelow.

Figure 3A:
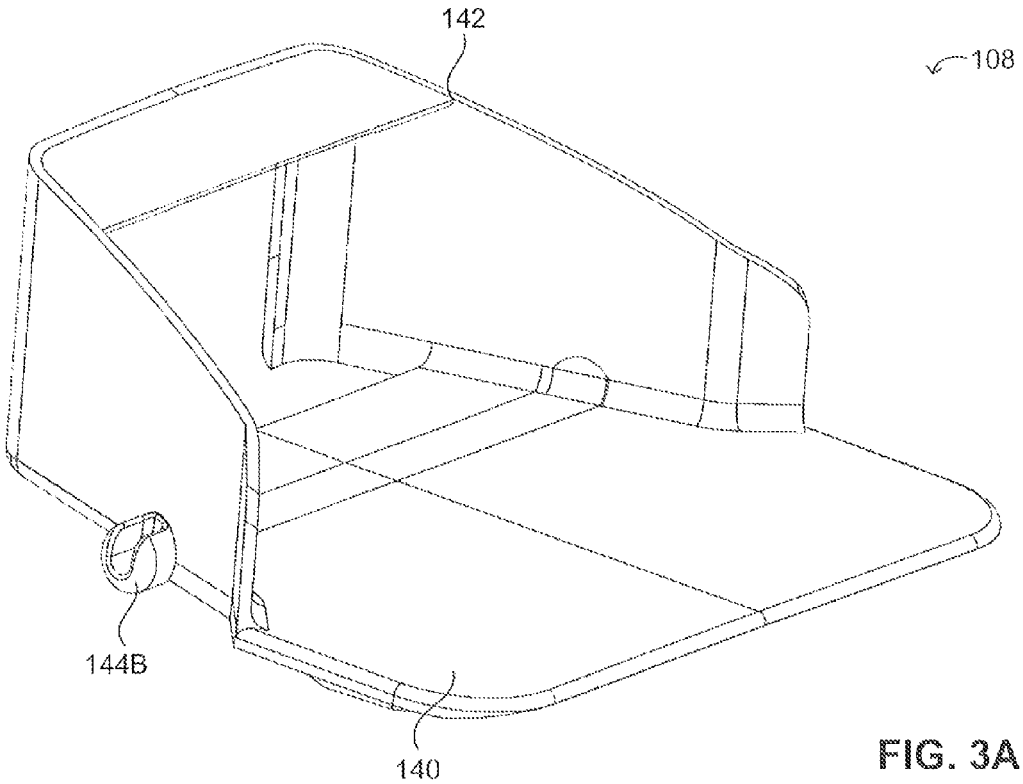
FIG. 3A is a schematic illustration in a perspective top view of the hinged ascending and descending cart ramp of the limb-exercising apparatus.
Figure 3B:
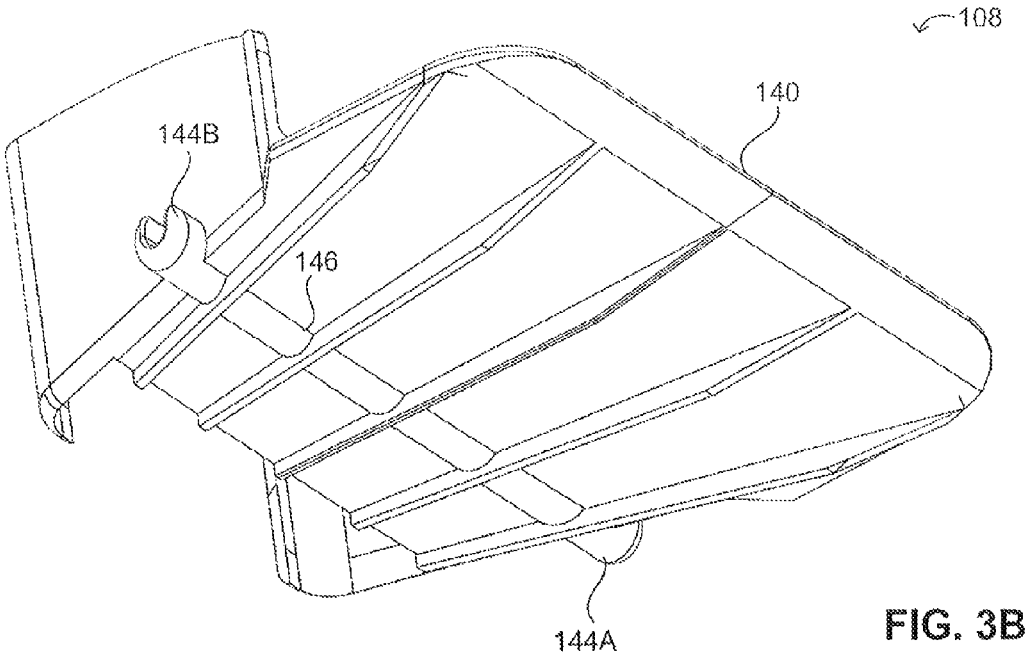
FIG. 3B is a schematic illustration in a perspective bottom view of the hinged ascending and descending cart ramp of the limb-exercising apparatus.

Reference is now further made to FIGS. 3A and 3B. FIG. 3A is a schematic illustration in a perspective top view of the hinged ascending and descending cart ramp of the limb-exercising apparatus. FIG. 3B is a schematic illustration in a perspective bottom view of the hinged ascending and descending cart ramp of the limb-exercising apparatus. Hinged ascending and descending cart ramp 108 includes a ramp portion 140, a retainer portion 142, transverse pivot pins 144A and 144B and optionally, a transverse through-hole (barrel) extending transversely within ramp portion 146. Transverse through-hole may optionally include an axle (not shown) that extends transversely therein. Transverse pivot pins 144A and 144B are coupled with rigid framework 102 in a manner that provides angular movement to hinged ascending and descending cart ramp 108 with respect rigid framework 102, at the pivot points.

Figure 4A:
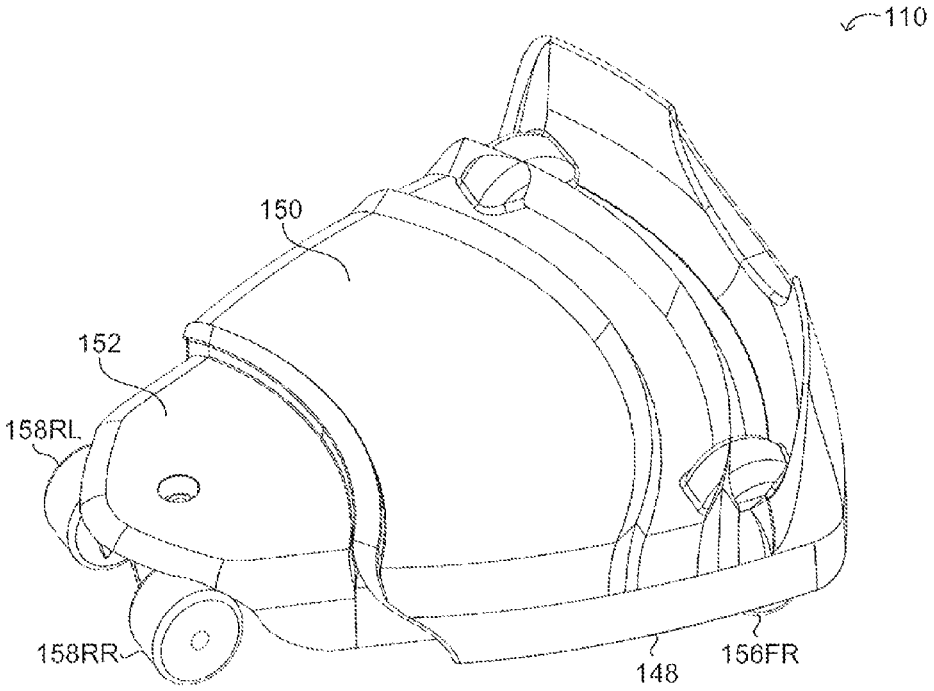
FIG. 4A is a schematic illustration in a perspective top view of the extendable and retractable cart of the limb-exercising apparatus.
Figure 4B:
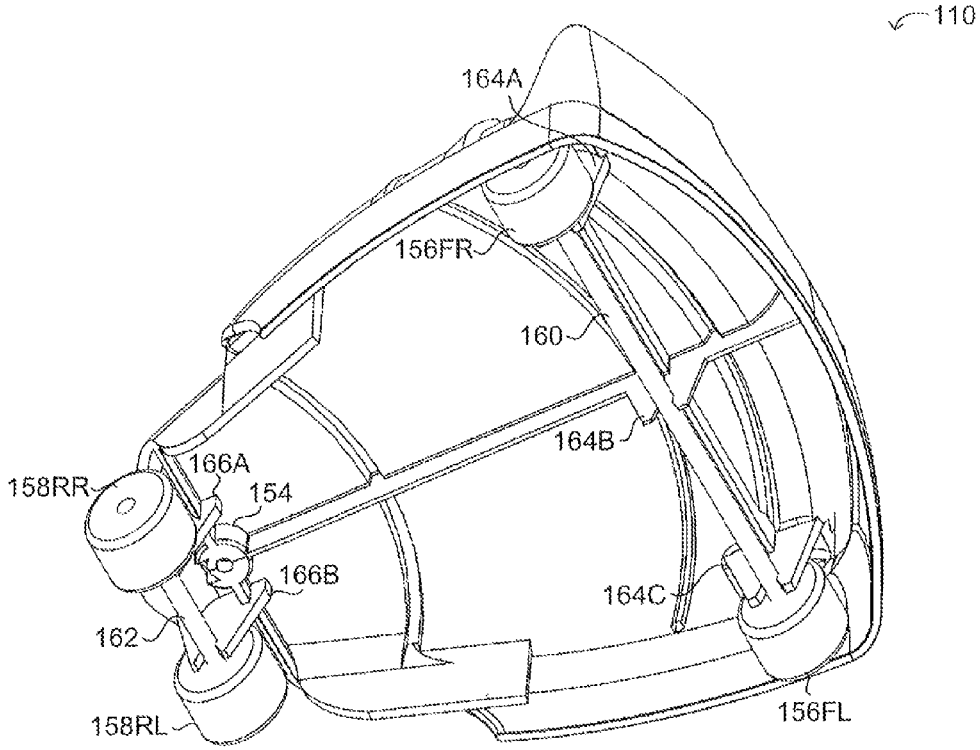
FIG. 4B is a schematic illustration in a perspective bottom view of the extendable and retractable cart of the limb-exercising apparatus.

Reference is now further made to FIGS. 4A and 4B. FIG. 4A is a schematic illustration in a perspective top view of the extendable and retractable cart of the limb-exercising apparatus. FIG. 4B is a schematic illustration in a perspective bottom view of the extendable and retractable cart of the limb-exercising apparatus. In general, extendable and retractable cart 110 is position-wise adjustable in relation to a position assumed by the swivel chair, such that there is at least one extended position where extendable and retractable cart 110 is at distance from framework 102, and at least one retracted position where the distance between extendable and retractable cart 110 and framework 102 (i.e., or hinged ascending and descending cart ramp 108) is substantially zero.

Extendable and retractable cart 110 includes a cart body 148, a footrest platform portion 150, a cart ramp retainer engaging portion 152, a cable coupling portion 154, a front right cart wheel 156FR, a front left cart wheel 156FL, a rear right cart wheel 158RR, a rear left cart wheel 158RL, a front wheels axle 160, a rear wheels axle 162, a plurality of front axle brackets 164A, 164B, and 164C, and a plurality of rear axle brackets 166A, and 166B. Front axle brackets 164A, 164B, and 164C, as well as rear axle brackets 166A, and 166B are formed as an integrated part of cart body 148. Alternatively, the brackets are distinct from and separate from cart body 148 and are assembled thereto during manufacture of limb-exercising apparatus 100. Front right cart wheel 156FR and front left cart wheel 156FL are each coupled with the opposite extremities of front wheels axle 160. Similarly, rear right cart wheel 158RR and front left cart wheel 158 are each coupled with the opposite extremities of rear wheels axle 162. Front wheels axle 160 is coupled with front axle brackets 164A, 164B, and 164C, such to allow free rotation thereof about the longitudinal axis of symmetry of front wheels axle 160. Similarly, rear wheels axle 162 is coupled with rear axle brackets 166A and 166B, such to allow free rotation thereof about the longitudinal axis of symmetry of rear wheels axle 162. Cable coupling portion 154 allows coupling cable 112 thereto (FIG. 2). Retainer portion 142 (FIGS. 3A and 3B) is operative to receive and accommodate ramp retainer engaging portion 152 when extendable and retractable cart 110 is in the retracted position, as shown in FIGS. 1 and 2. Footrest platform portion 150 is constructed and operative to provide support for a foot or feet of a user (not shown), operating limb-exercising apparatus. The front and rear wheels are thus operative to allow extendable and retractable cart 110 to freely move across the ground upon which they are supported. Alternatively, extendable and retractable cart 110 includes at least one wheel (e.g., a multi-directional wheel) coupled to cart body 148 (i.e., typically to the underside thereto) for supporting (multi-directional) movement of extendable and retractable cart 110 upon the ground (not shown).

Figure 5A:
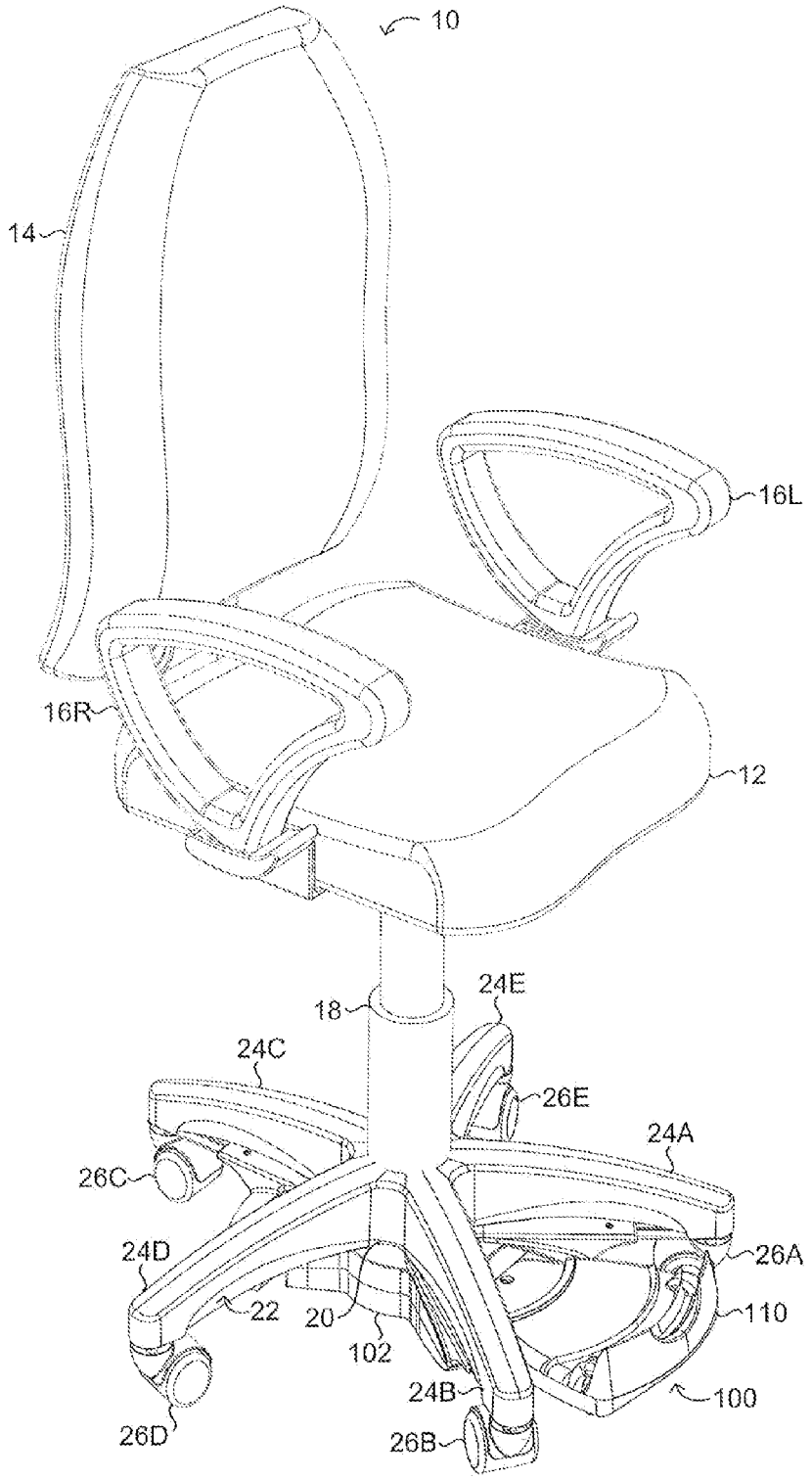
FIG. 5A is a schematic illustration in top perspective view of the limb-exercising apparatus of FIG. 1, being at a particular operative state, coupled with a swivel chair.
Figure 5B:
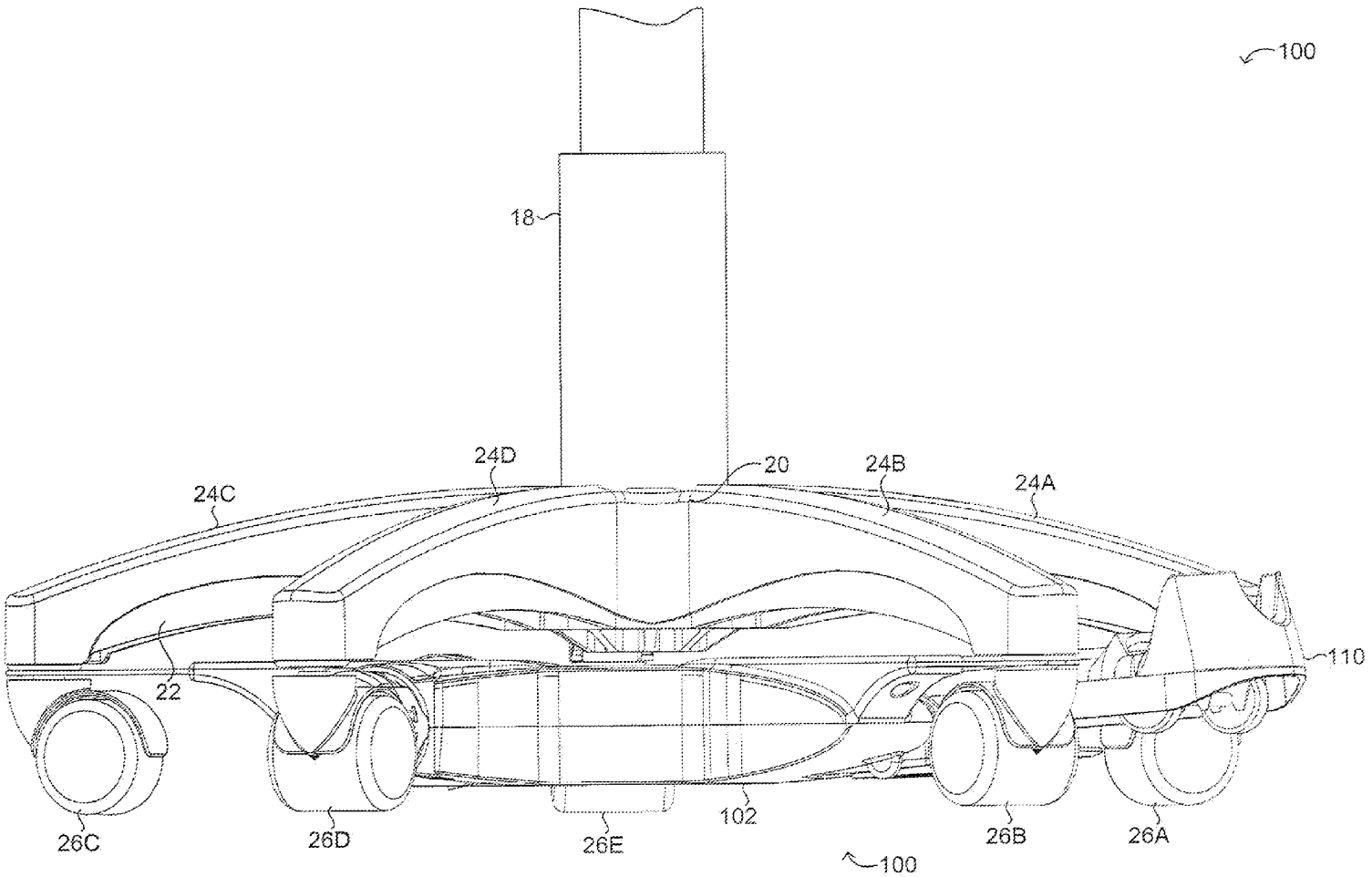
FIG. 5B is a schematic illustration showing a detailed side view of the coupling of limb-exercising apparatus with the underside of a chair leg base of the swivel chair of FIG. 5A.
Figure 6A:
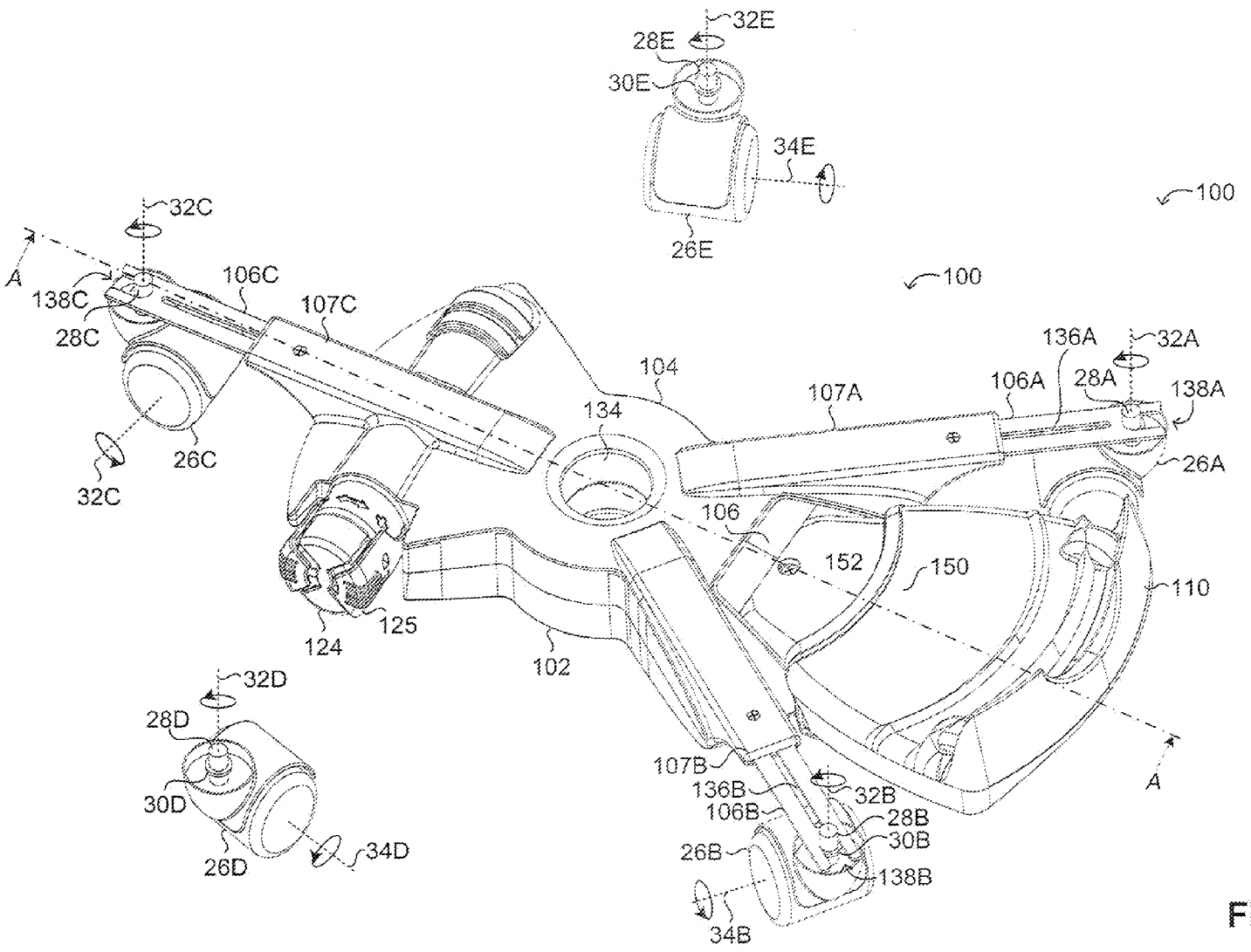
FIG. 6A is a schematic illustration showing a detailed top perspective view of the coupling of limb-exercising apparatus with a plurality of castor pivotal pins.
Figure 6B:
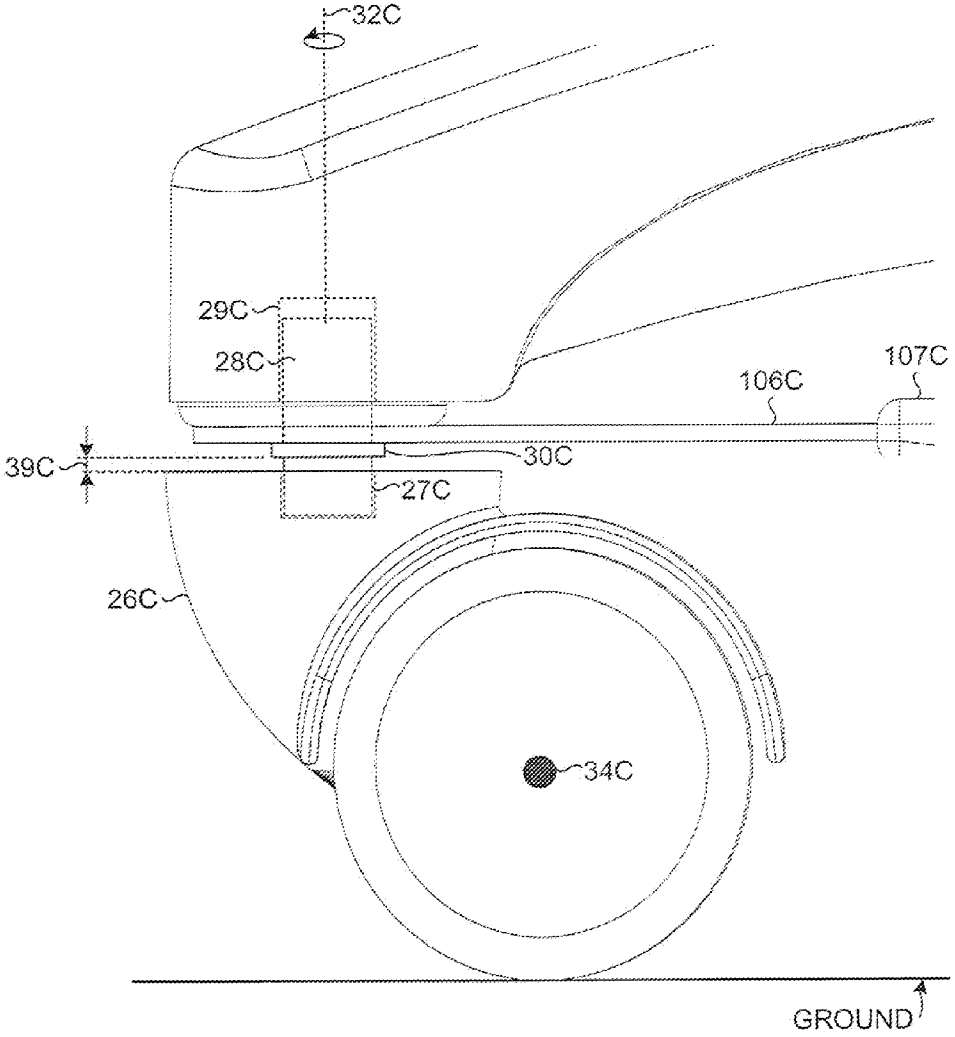
FIG. 6B is a schematic illustration showing a detailed side view of the coupling of a chair coupler with a castor pivotal pin.

Limb-exercising apparatus 100 is constructed and operative to be coupled with an underside of a chair leg base that includes a plurality of chair legs of a swivel chair. For further detail, reference is now further made to FIGS. 5A, 5B, 6A and 6B. FIG. 5A is a schematic illustration in top perspective view of the limb-exercising apparatus of FIG. 1, being at a particular operative state, coupled with a swivel chair. FIG. 5B is a schematic illustration showing a detailed side view of the coupling of limb-exercising apparatus with the underside of a chair leg base of the swivel chair of FIG. 5A. FIG. 6A is a schematic illustration showing a detailed top perspective view of the coupling of limb-exercising apparatus with a plurality of castor pivotal pins, and FIG. 6B is a schematic illustration showing a detailed side view of the coupling of a chair coupler with a castor pivotal pin. Swivel chair 10 (FIG. 5A) typically includes a seat 12, a backrest 14, a right arm support 16R, a left arm support 16L, an elongated vertical seat support 18, a chair leg base 20, a plurality of chair legs 24A, 24B, 24C, 24D 24E that together with chair leg base 20 have a common underside 22 (FIG. 5B), a plurality of castors 26A, 26B, 26C, 26D, and 26E, and a plurality of pivotal pins 28A, 28B, 28C, 28D, and 28E (FIG. 6A). Each one of pivotal pins 28A, 28B, 28C, 28D, and 28E typically includes a respective flange 30A, 30B, 30C, 30D, and 30E (FIG. 6A).

A general connectivity between parts of a typical multi-legged (usually five-legged) swivel chair (e.g., swivel chair 10) is such that elongated vertical seat support 18 rotatably couples between seat 12 and chair leg base 20, providing full (i.e., 360°) rotational movement of seat 12 with respect to chair leg base 20. Seat 12 supports (most of) the weight of a user (sitter—not shown) seated thereon, backrest 14 provides support to the back (not shown) of the user, and respective right and left arm supports 16R and 16L, each coupled with a respective side of seat 12, provide support for the arms (not shown) of the user. Each one of castors 26A, 26B, 26C, 26D, and 26E is rotatably coupled with underside 22 of a respective chair leg 24A, 24B, 24C, 24D, and 24E via a respective pivotal pin 28A, 28B, 28C, 28D, and 28E. Each pivotal pin 28A, 28B, 28C, 28D, and 28E includes respective flanges 30A, 30B, 30C, 30D, and 30E that circumferentially project from the respective pivotal pin (i.e., about each pivotal pin longitudinal rotation axis), such that the outer diameter of each flange is approximately 4 millimeters larger that the diameter of its respective pivotal pin. Each one of flanges 30A, 30B, 30C, 30D, and 30E has a width of approximately 2 millimeters (i.e., in other words, when a pivotal pin is in the vertical direction, its respective flange is approximately 2 millimeters in height). Each pivotal pin 28A, 28B, 28C, 28D, and 28E extends upwardly across gaps (i.e., typically on the order of 2 millimeters in the vertical direction) that exist between underside 22 of the chair legs and each castor. Each such gap allows castors 26A, 26B, 26C, 26D, and 26E to rotate freely about their respective longitudinal pivotal pin rotation axes 32A, 32B, 32C, 32D, and 32E (in the vertical direction), as shown in FIG. 6A. Furthermore, castors 26A, 26B, 26C, 26D, and 26E are operative to rotate about their respective castor rotation axes 34A, 34B, 34C, 34D, and 34E (in the horizontal direction) thereby providing swivel chair 10 with freedom to move across the ground upon which it is supported.

Limb-exercising apparatus 100 is constructed and operative to be coupled with underside 22 of swivel chair leg base 20. The coupling of limb-exercising apparatus 100 with swivel chair 10 will now be described in greater detail. In accordance with the present embodiment of the disclosed technique, limb-exercising apparatus 100 is coupled with swivel chair 10 within the gaps that exist between underside 22 and castors 26A, 26B, 26C, such that at least three chair couplers 104A, 104B and 104C are each respectively coupled with at least one pivotal pin 28A, 28B, and 28C, as shown in FIG. 6A. Specifically, U-shaped notches 138A, 138B, and 138C are inserted such that they at least partially circumferentially engage with the top part of respective flanges 30A, 30B, and 30C, and thus support the weight of limb-exercising apparatus 100 positioned thereon (FIGS. 6A, 6B, and 5B). The coupling of U-shaped notches 138A, 138B, and 138C with respective flanges 30A, 30B, and 30C does not interfere with rotational movement of respective castors 26A, 26B, and 26C about their respective vertical axes 32A, 32B, and 32C. U-shaped notches 138A, 138B, and 138C are detached (i.e., to not make contact with) from respective castors 26A, 26B, and 26C such to allow rotation of these castors about their respective rotation axes.

FIG. 6B illustrates a magnified side view of the coupling of one of the chair couplers (i.e., without loss of generality, for example, chair coupler 106C) coupled with a respective pivotal pin (respectively, i.e., pivotal pin 28C) such that chair coupler 106C is supported by flange 30C. As aforementioned, between the chair couplers (i.e., without loss of generality, chair coupler 106C in FIG. 6B) and the pivotal pins (i.e., pivotal pin 28C) there exist gaps that permit each of the castors (i.e., castor 26C) to rotate about their respective vertical pivotal pin rotation axes (i.e., longitudinal pivotal pin vertical rotation axis 32C), as well as permits the castors (i.e., castor 26C) to rotate about their respective horizontal castor rotation axes (i.e., horizontal castor rotation axis 34C). The part in the vertical direction that is below flange 30C is inserted into a castor vertical cylindrical groove 27C that exists in the body of castor 26C, such that the internal diameter of castor vertical cylindrical groove 27C is slightly larger than the diameter of pivotal pin 28C. The vertical length of pivotal pin 28C in the part that is below flange 30C is slightly longer than the vertical depth of castor vertical cylindrical groove 27C, such that there exists an approximately a 1 millimeter gap 39C between flange 30C and castor 26C, as shown in FIG. 6B. Gap 39C and castor vertical cylindrical groove 27C thus allow castor 26C to rotate freely about its pivotal pin rotation axis 32C, as there is no contact between chair coupler 106 and castor 26C. The other end of pivotal pin 28C (i.e., the part that is above flange 30C) is inserted into a chair leg vertical cylindrical groove 29C that is slightly larger in diameter than the diameter of pivotal pin 28C, as shown in FIG. 6B.

The rigid coupling of framework 102 with swivel chair 10, involves fixatedly adjusting the outward projection lengths of chair couplers 106A, 106B, and 106C (i.e., via respective elongated slots 136A, 136B, and 136C) so that they engage with respective pivotal pins 28A, 28B, and 28C. Each chair coupler 106A, 106B, and 106C is typically constructed from a rigid material such as metal (e.g., steel), reinforced plastic, or other suitable material, whose thickness is such to allow the sufficient vertical length of pivotal pins 28A, 28B, and 28C to remain securely lodged within respective castor vertical cylindrical grooves 27A (not shown), 27B (not shown), and 27C. This coupling provides a rigid connection of rigid framework 102 with swivel chair 10, such that the relative movement therebetween is minimal. Chair couplers 106A, 106B, and 106C are extendable-retractable with respect to respective elongated guides 107A, 107B, and 107C such to facilitate coupling of rigid framework 102 with different swivel chairs of varying chair leg lengths. Alternatively, chair couplers 106A, 106B and 106C are angularly variable (not shown) with respect to framework 102 so as to allow coupling with swivel chairs having differently angular displaced leg configurations (i.e., multi-legged swivel chairs whose chair legs are not displaced in equiangular relationship therebetween).

Figure 7A:
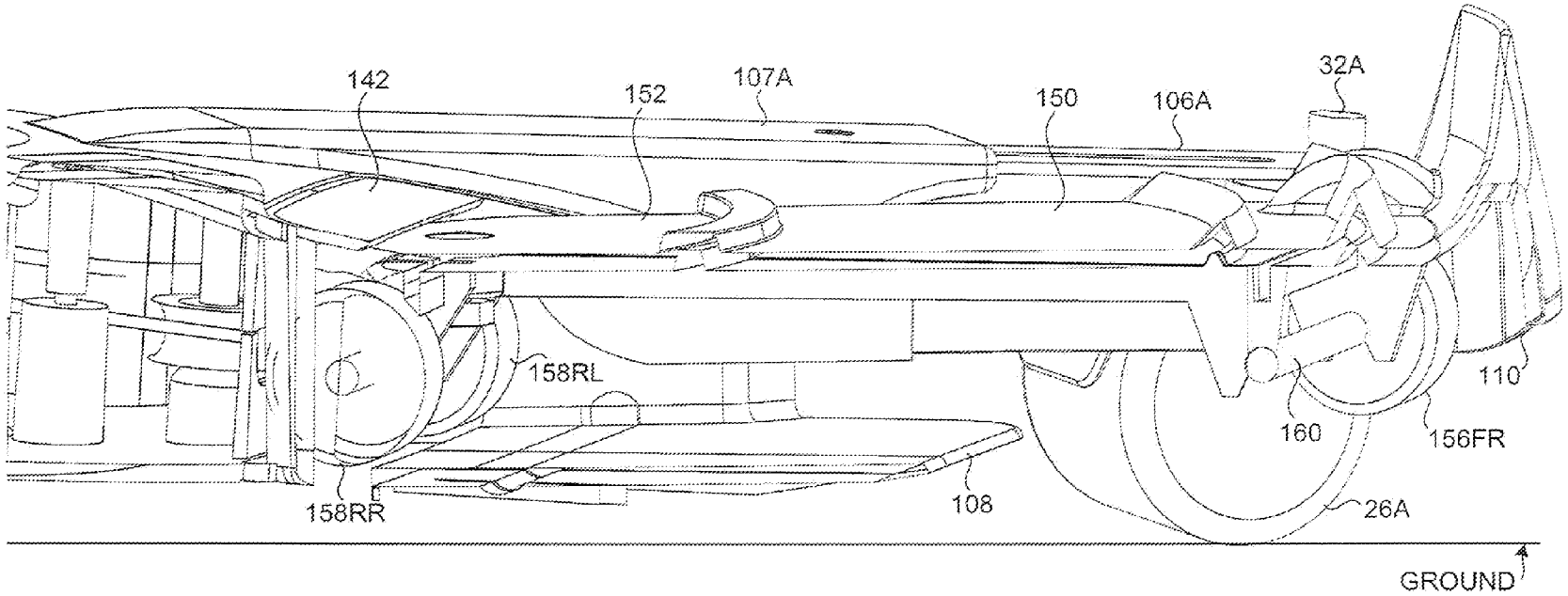
FIG. 7A is a schematic illustration of a partial side cross-sectional view of the limb-exercising apparatus, along lines A-A of FIG. 6A, showing hinged ascending and descending cart ramp in an ascended position.
Figure 7B:
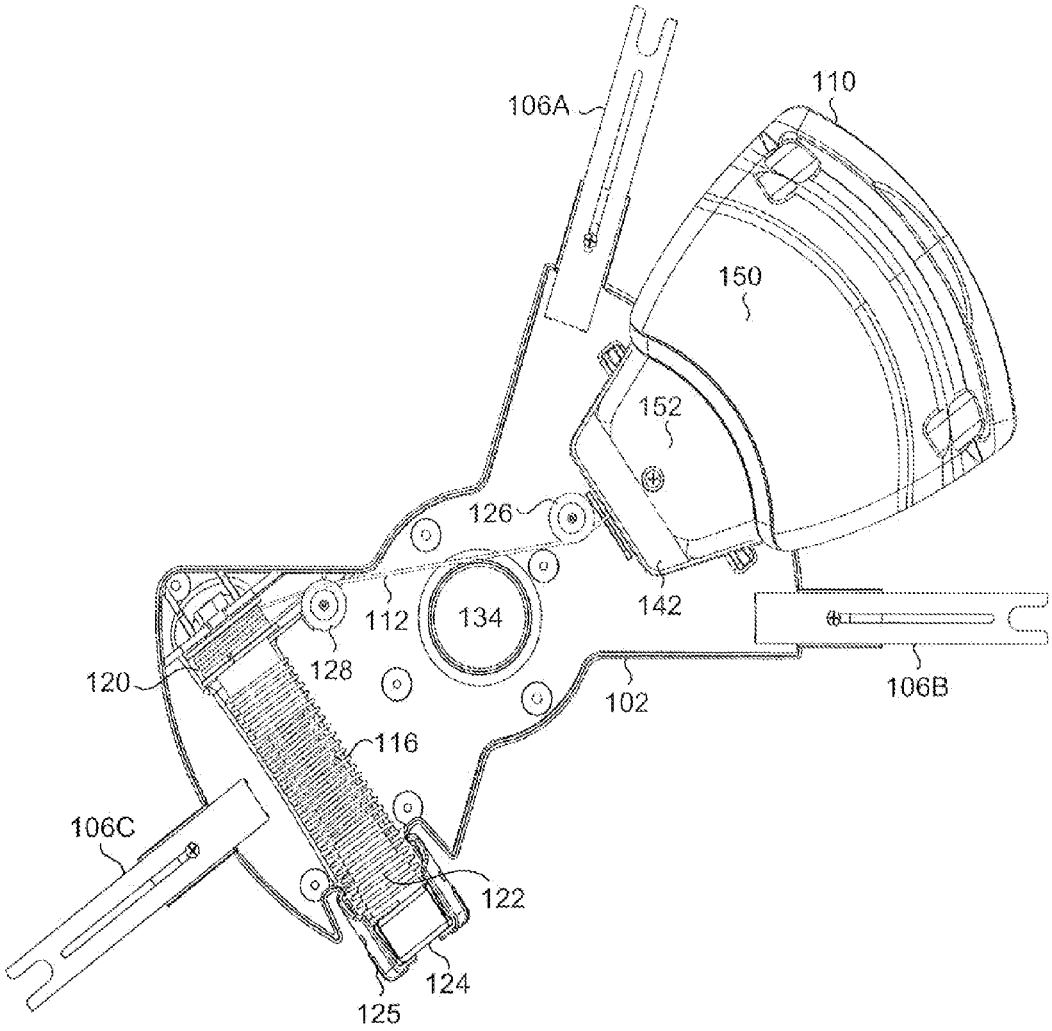
FIG. 7B is a schematic illustration of a top internally exposed view of the limb-exercising apparatus showing extendable and retractable cart in a retracted position.
Figure 8A:
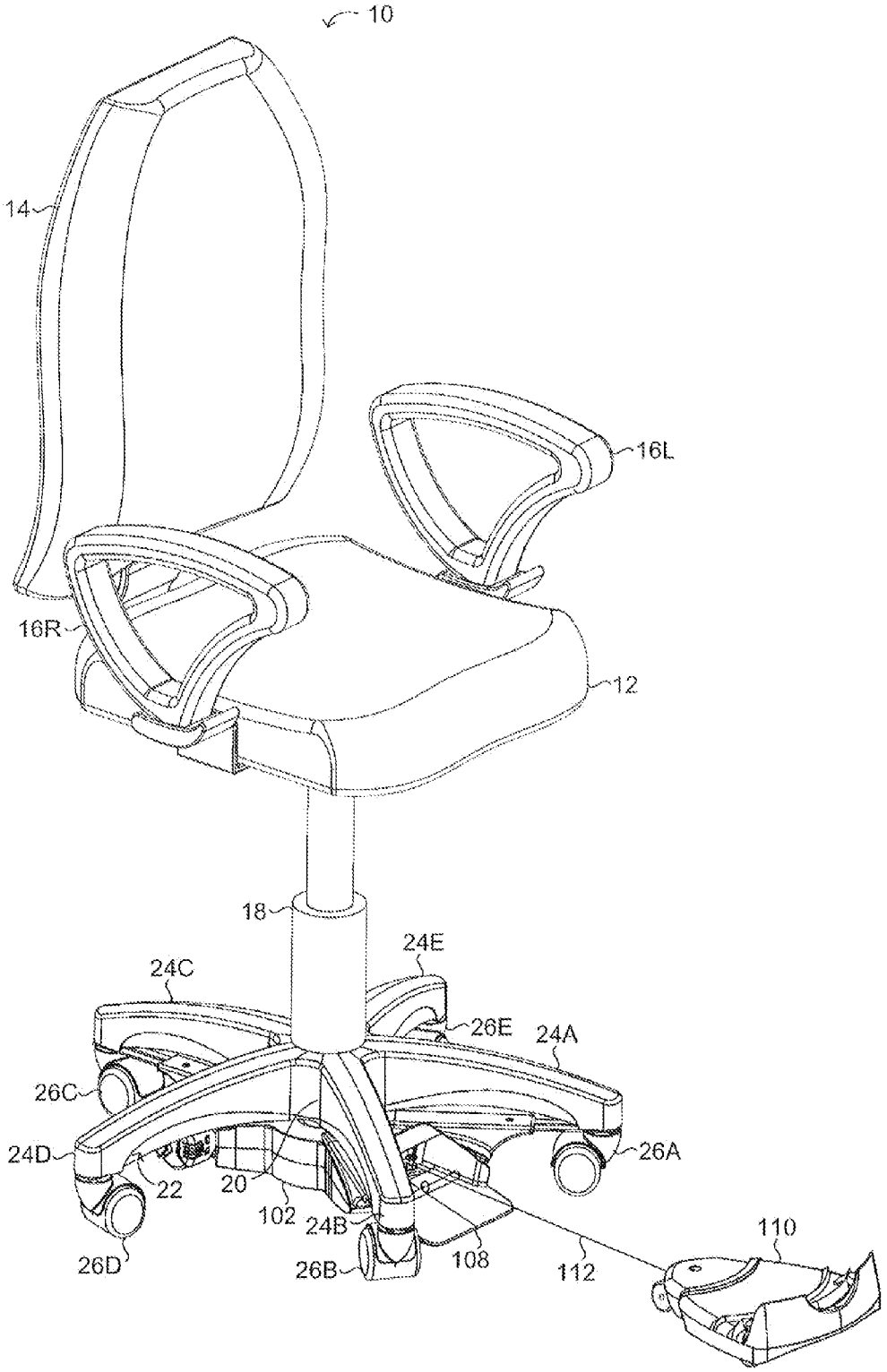
FIG. 8A is a schematic illustration in perspective view of the limb-exercising apparatus in another operative state in which the hinged ascending and descending cart ramp is in a descended position and extendable and retractable cart in an extended position.
Figure 8B:
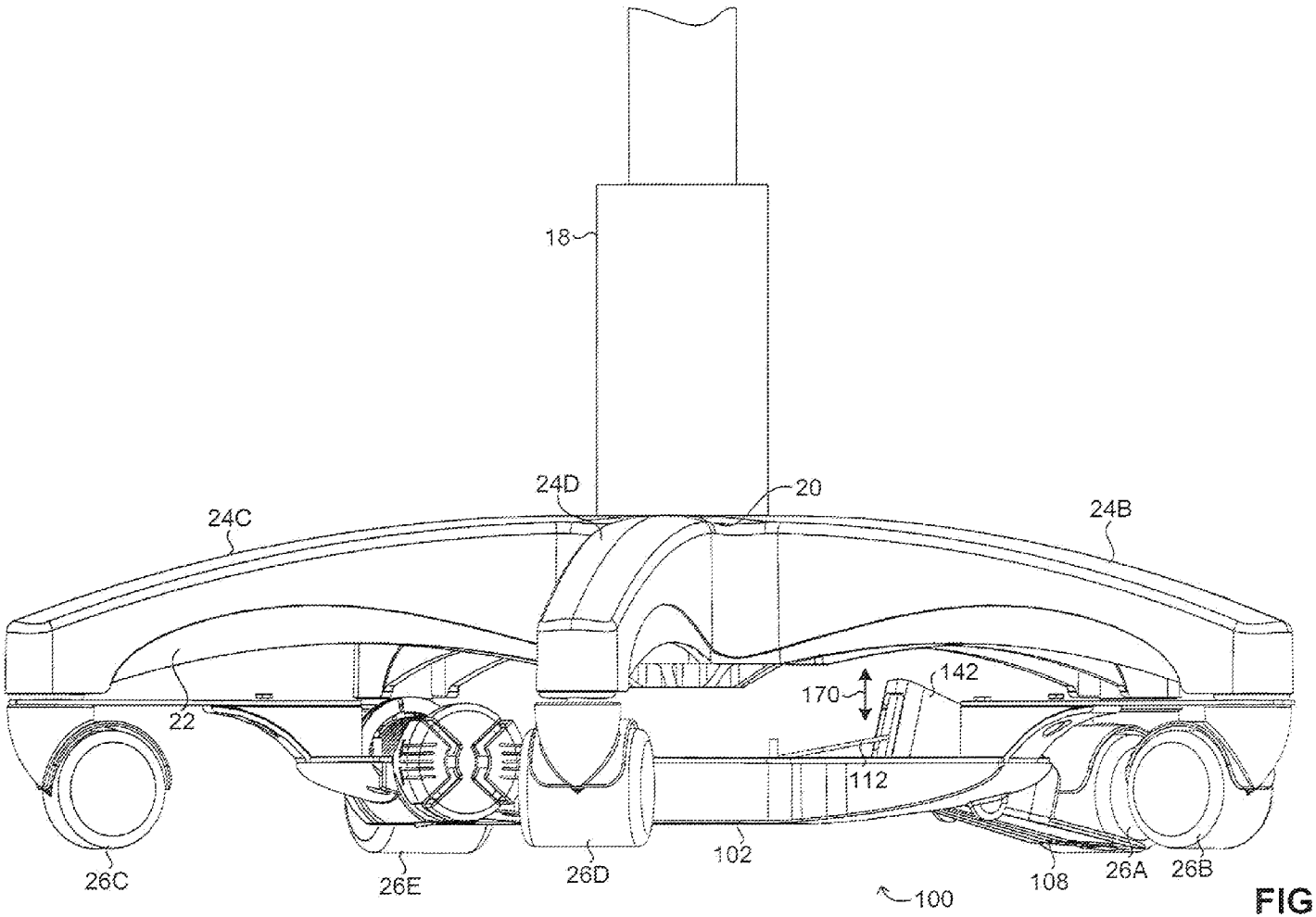
FIG. 8B is a schematic illustration of the limb-exercising apparatus in side view, showing hinged ascending and descending cart ramp in a descended position.
Figure 8C:
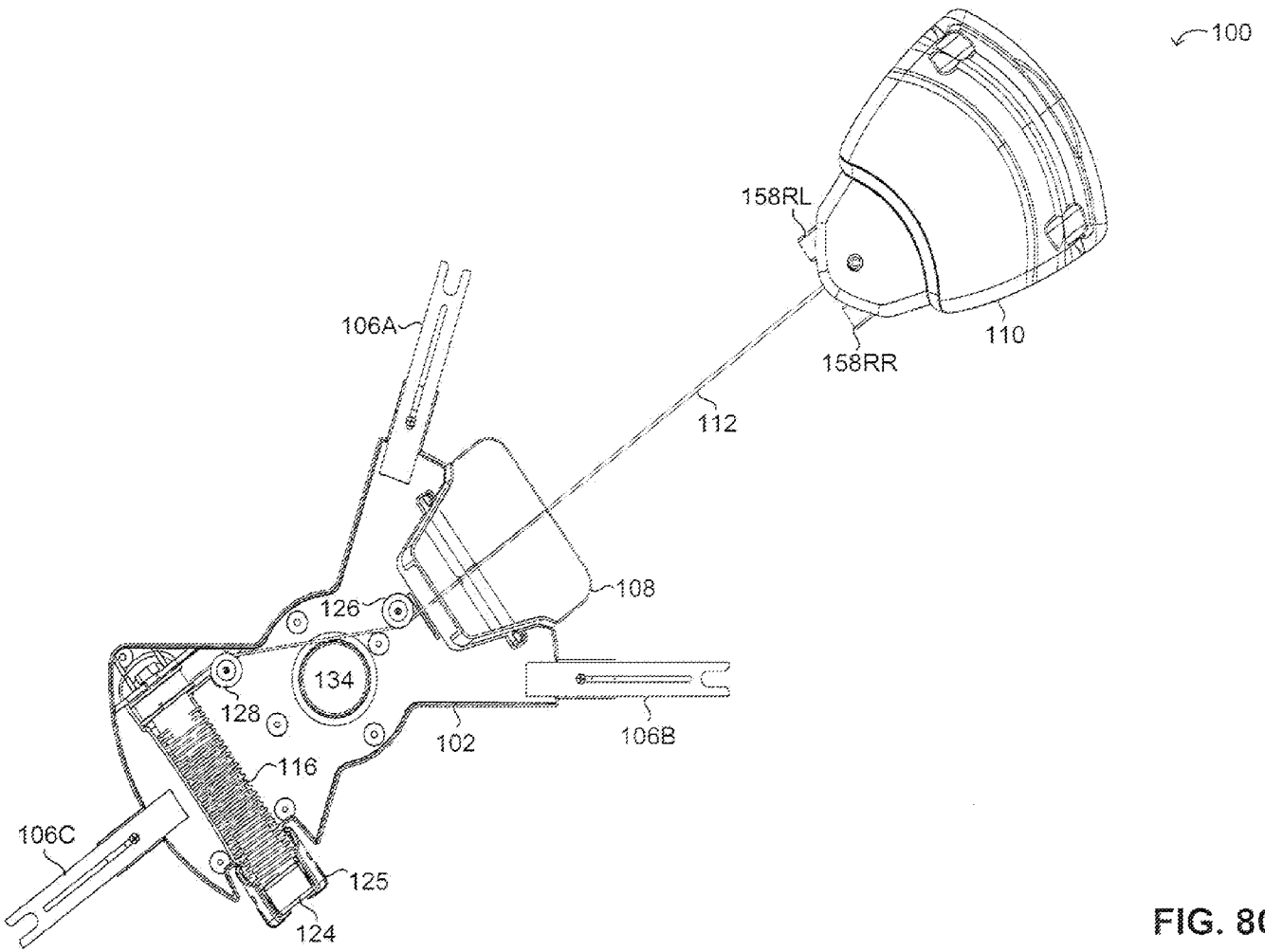
FIG. 8C is a schematic illustration of a top internally exposed view of the limb-exercising apparatus showing extendable and retractable cart in an extended position.

In general, operation and use of limb-exercising apparatus 100 (by a user thereof) enables the user to exercise muscle groups of the legs (e.g., the quadriceps, etc.) while in a seated position in swivel chair 10. Limb-exercising apparatus 100 enables the user to exercise either left or right legs separately, or both legs simultaneously. Exercising and training typically involves working the leg muscles by repeatedly moving against resistance the extendable and retractable cart across the ground. Essentially, there are two distinct and extreme positions that are realized with limb-exercising apparatus 100 that will be termed as: the fully retracted position and the fully extended position. Commonsensically, there are a multitude of other intermediate positions that can be attained within this range between the fully retracted position and the fully extended position (not shown). The operation and use of limb-exercising apparatus 100 will now be described in greater detail in conjunction with the following drawings. Reference is now further made to FIGS. 7A, 7B, 8A, 8B, and 8C. FIG. 7A is a schematic illustration of a partial side cross-sectional view of the limb-exercising apparatus, along lines A-A of FIG. 6A, showing hinged ascending and descending cart ramp in an ascended position. FIG. 7B is a schematic illustration of a top internally exposed view of the limb-exercising apparatus showing extendable and retractable cart in a retracted position. FIG. 8A is a schematic illustration in perspective view of the limb-exercising apparatus in another operative state in which the hinged ascending and descending cart ramp is in a descended position and extendable and retractable cart in an extended position. FIG. 8B is a schematic illustration of the limb-exercising apparatus in side view, showing hinged ascending and descending cart ramp in a descended position, and FIG. 8C is a schematic illustration of a top internally exposed view of the limb-exercising apparatus showing extendable and retractable cart in an extended position.

In general, hinged ascending and descending cart camp 108 is operative to assume a fully ascended position and a fully descended position. In the fully ascended position limb-exercising apparatus 100 keeps away from contact with the ground, and in the fully descended position, both hinged ascending and descending cart ramp 108 and extendable retractable cart 110 make contact with a substantially flat ground upon which the swivel chair is supported. Prior to operating limb-exercising apparatus 100, a user assumes a seated position (not shown) in swivel chair 10. In this initial position of user, prior to the commencement of physical exercise on limb-exercising apparatus 100, extendable and retractable cart 110 is at the fully retracted position, as shown in FIGS. 7A and 7B (i.e., as well as in FIGS. 1, 2, 5A, 5B, and 6A). In this fully retracted position, retainer portion 142 of hinged ascending and descending cart ramp 108 receives and accommodates cart engaging portion 152. Hinged ascending and descending cart ramp 108 is in an ascended (i.e., raised) position above the ground (i.e., does not make contact with the ground). In the fully retracted position, no elements of limb-exercising apparatus 100 make contact with the ground, such that the mobility of swivel chair 10 is not impaired and is thus free to move on the ground upon which it is supported. In particular, front right cart wheel 156FR, front left cart wheel 156FL (not shown in FIG. 7A), rear right cart wheel 158RR, rear left cart wheel 158RL are distanced above the ground, as shown in FIG. 7A. Rear right cart wheel 158RR and rear left cart wheel 158RL are supported on cart ramp 108, when hinged ascending and descending cart ramp 108 is in the fully ascended position. FIG. 7B shows a top internally exposed view of the limb-exercising apparatus 100 in the retracted position as well as the path of cable 112. In this retracted position the extension of cable 112 is least.

To perform exercises on limb-exercising apparatus 100, the user initially places his or her feet on footrest platform portion 150 of extendable and retractable cart 110. Limb-exercising apparatus 100 enables the user to perform resistance exercises against the resistance to movement or twisting provided by the force resistor (e.g., helical torsion spring 116), whether in an action that progressively pushes against resistance or conversely, in an action that progressively releases against resistance.

Pushing against resistance exercises involves the user impelling extendable and retractable cart 110 forward and away from swivel chair 10, toward the fully extended position of limb-exercising apparatus 100 or any other intermediate position thereof, against the resistance of helical torsion spring 116, in a manner that induces muscular contraction of the user's leg muscles. FIGS. 8A and 8C show limb-exercising apparatus 100 in the fully extended position, where extendable and retractable cart 110 is in the extended position and hinged ascending and descending cart ramp 108 is in a descended position such that ramp portion 140 makes contact with the ground. FIG. 8B illustrates hinged ascending and descending cart ramp 108 in the descended position such that its pivoting motion allows it to ascend and descend, as indicated by double-sided arrow 170. Whereas the ascended (i.e., raised) position of hinged ascending and descending cart ramp 108 functions to support and hold extendable and retractable cart 110 in place and away from ground, the descended (i.e., lowered) position creates an inclined slope that functions to smoothly guide extendable and retractable cart 110 to-and-fro the ground. FIG. 8C shows a top internally exposed view of the limb-exercising apparatus 100 in the fully extended position as well as the path of cable 112. In this fully extended position, the extension of cable 112 is greatest.

Releasing against resistance exercises involves the user gradually resisting the pulling force exerted on extendable and retractable cart 110 by helical torsion spring 116 via cable 112 from any extended position (i.e., full or intermediate) toward the fully retracted position of limb-exercising apparatus 100 or any other intermediate position thereof. This reverse-resistance action, in the opposite direction, also provides exercise to the user, by inducing muscular contraction of the user's leg muscles.

Tension adjuster 124 includes a plurality of settings (not shown) that correspondingly determine the amount of resistance exerted by helical torsion spring 116. Specifically, the amount of resistance provided by helical torsion spring 116, and thus the amount of physical exertion or load required for progressively extending or retracting extendable and retractable cart 110 can be controlled by rotating tension adjuster 124 (FIGS. 1, 2, 6A 7B, 8B, 8C) in the clockwise (denoted by "+") or anti-clockwise (denoted by "−") directions. When rotating tension adjuster 124 is rotated, the relative difference in angular positions between extremities 117R and 117L of helical torsion spring 116 is changed (i.e., with respect to its previous state), such that helical torsion spring 116 exerts a torque in the opposite direction of the rotation (twisting/untwisting) that is proportional to the changed difference in the angular positions. Locking mechanism 125 locks the angular position of tension adjuster 124 to a particular setting, which in turn establishes the appropriate amount of resistance or load desired by the user.

In accordance with another embodiment of the disclosed technique, the limb-exercising apparatus is constructed and operative to be coupled with the swivel chair leg base, such that limb-exercising apparatus is located at the underside of the swivel chair leg base, without necessitating coupling to the pivotal pins of the swivel chair. In such an implementation, the limb-exercising apparatus includes at least one chair coupler that is operative to couple the rigid framework of the limb-exercising apparatus with the underside of the swivel chair leg base, such that the relative movement between the rigid framework and the swivel chair is minimal. Alternatively, the top cover, to which the rigid framework is coupled with, is coupled to the underside of the swivel chair leg base. Such couplings (i.e., between rigid framework and underside of swivel chair) may be realized by various techniques such as, for example, by fastening (e.g., via screws, snap fasteners, Velcro®, etc.), adhering (i.e., by an adhesive), strapping, clasping, molding together in the manufacturing phase the framework or top covering thereof with the underside of swivel chair base, and the like.

Figure 9A:
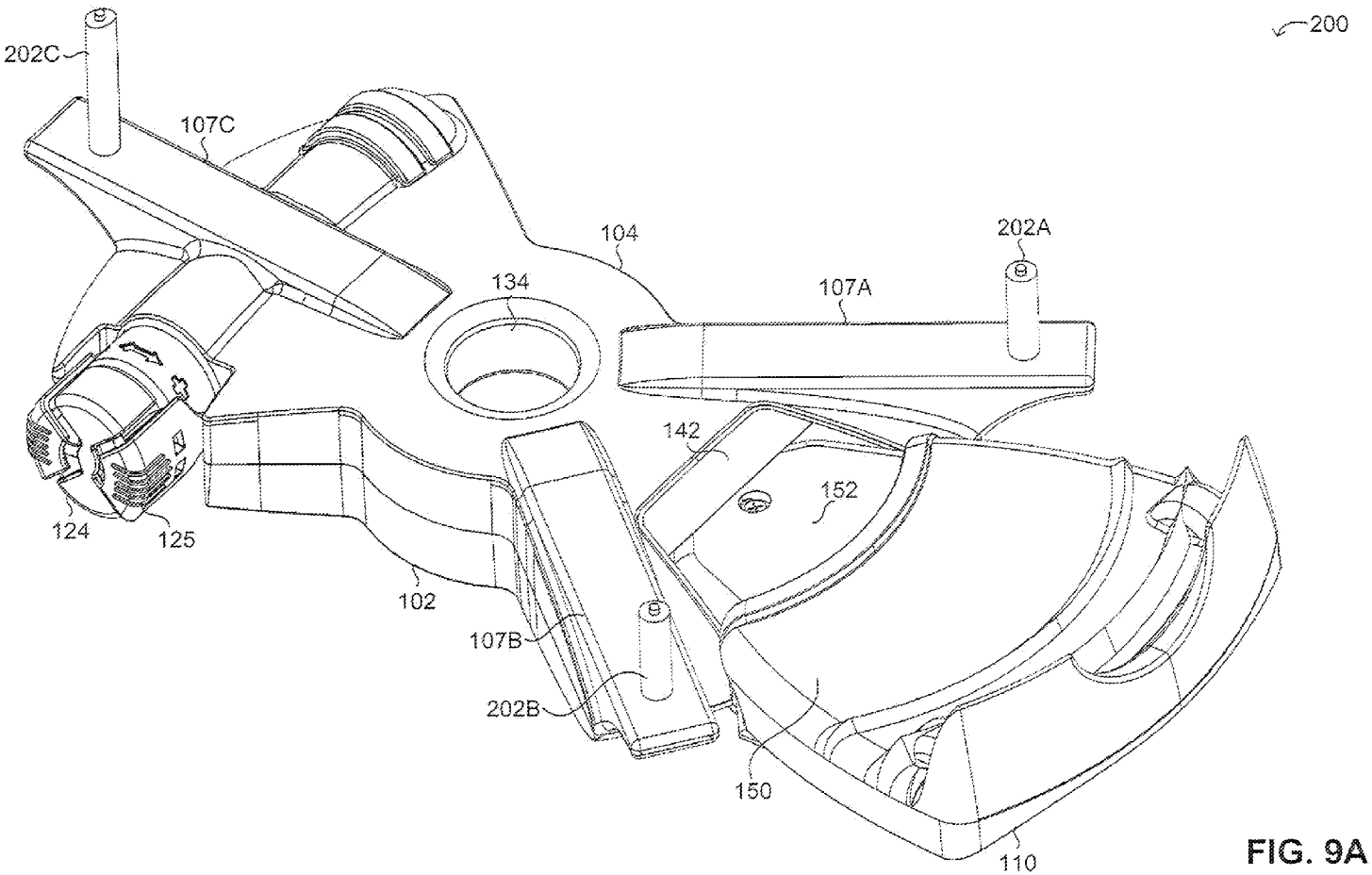
FIG. 9A is a schematic illustration in a perspective top view of a limb-exercising apparatus, constructed and operative according to another embodiment of the disclosed technique.
Figure 9B:
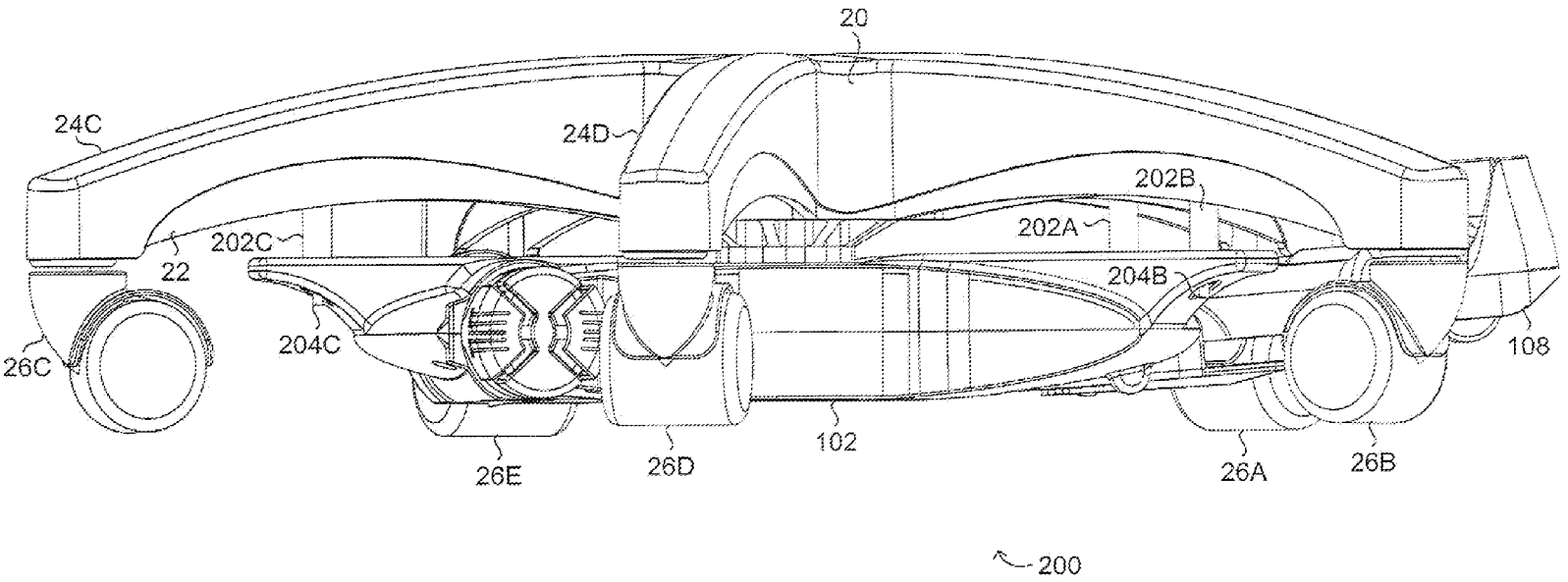
FIG. 9B is a schematic illustration of a side view of the limb-exercising apparatus of FIG. 9A.

To further elucidate the particulars of this embodiment, reference is now made to FIGS. 9A and 9B. FIG. 9A is a schematic illustration in a perspective top view of a limb-exercising apparatus, generally referenced 200, constructed and operative according to another embodiment of the disclosed technique. FIG. 9B is a schematic illustration of a side view of the limb-exercising apparatus of FIG. 9A. Limb-exercising apparatus 200 is essentially identical with limb-exercising apparatus 100, described in conjunction with FIGS. 1 through 8C, apart from the fact that chair couplers 106A, 106B, 106C that were constructed to couple framework 102 with respective pivotal pins 28A, 28B and 28C of swivel chair 10, have now been replaced by chair couplers 202A, 202B and 202C, which in turn are operative to couple framework 102 (or top cover 104 thereof) with underside 22 of swivel chair leg base 20. Since all other components of limb-exercising apparatus 200, with respect to construction, connectivity and operation, remain unchanged in comparison to those of limb-exercising apparatus 100, their reference numbers will be preserved throughout the following description of limb-exercising apparatus 200.

FIGS. 9A and 9B illustrate chair couplers 202A, 202B and 202C vertically disposed along and coupled with respective elongated guides 107A, 107B and 107C. Chair couplers 202A, 202B, and 202C effectively couple framework 102 with underside 22 of swivel chair leg base 20, such that the relative movement between rigid framework 102 and swivel chair 10 is minimal. Chair couplers 202A, 202B, and 202C are embodied as elongated rods snap fasteners that project vertically from the surfaces of elongated guides 107A, 107B, and 107C toward their respective coupling points (not shown) on underside 22. Their coupling is typically reinforced by the use of screws 204A, 204B, and 204C. Alternatively, chair couplers 202A, 202B, and 202C are (at least partially internally or externally) threaded so as to be received and mated with complementary threaded (i.e., respective grooves or shafts) that are formed into underside 22 (not shown).

The coupling of limb-exercising apparatus 200 with swivel chair 10 is not limited only to the use of a particular type and quantity of chair couplers (e.g., three), for it may be implemented by only one chair coupler, such as in the case of the use of an adhesive material (i.e., that bonds top cover 104 with underside 22), a thermo-adhesive material (not shown), a single mechanical coupler mechanism (e.g., a arbitrarily-shaped mechanical structure, a structure that at least partially surrounds or partially within circular through-hole 134, a three-bar linkage, a four-bar linkage, etc.), an apparatus having multiply distinct components, or any other suitable mechanical structure or structures that may be used and adapted for achieving that purpose. Further alternatively, limb-exercising apparatus 200 is still located at the underside of the swivel chair leg base 20 but is coupled with any part (i.e., including upper and/or side portions) of swivel chair leg base 20 by employing for example, wires (not shown), strings (not shown), mechanical fittings (not shown), an array of fasteners (not shown), and the like. Further alternatively, at least part of limb-exercising apparatus 100 (e.g., top cover 104) is formed with at least part of chair leg base 20 in their mutual manufacturing process, such that part of limb-exercising apparatus 100 is incorporated into part of swivel chair 10 (e.g., underside 22 of chair leg base 20).

It will be appreciated by persons skilled in the art that the disclosed technique is not limited to what has been particularly shown and described hereinabove. Rather the scope of the disclosed technique is defined only by the claims, which follow.

The invention claimed is:

1. A limb-exercising apparatus for coupling to a swivel chair, the swivel chair includes a plurality of chair legs that define a chair leg base that has an underside, the limb-exercising apparatus comprising:

a rigid framework that includes at least one chair coupler that couples said rigid framework with said underside of said chair leg base, such that said rigid framework and said limb-exercising apparatus are disposed underneath said chair leg base, and such that a relative movement between said rigid framework and said swivel chair is minimal;

at least one limb-exercising unit, coupled with said rigid framework, each one of said at least one limb-exercising unit is operative to provide movement exercise for at least one muscle group of a body of a user;

a force resistor coupled with said rigid framework and with said at least one limb-exercising unit, said force resistor providing resistance to movement of said at least one limb-exercising unit; and a cable that couples between said at least one limb-exercising unit and said force resistor.

2. The limb-exercising apparatus according to claim 1 wherein said at least one chair coupler is selected from the list comprising of:

at least one elongated rod fastener that projects from said rigid framework to said underside;

at least one threaded shaft to be mated with at least one respective complementary groove in said underside;

at least one threaded groove to be mated with at least one respective complementary shaft in said underside;

an adhesive material;

a thermo-adhesive material;

a single mechanical coupler mechanism;

wires;

an array of fasteners;

a part of said chair leg base that is formed with at least part of said limb-exercising apparatus in a manufacturing process thereof; and an apparatus having multiple distinct components.

3. The limb-exercising apparatus according to claim 1, further comprising a hinged ascending and descending cart ramp pivotally coupled with said rigid framework, such to provide angular movement to said hinged ascending and descending cart ramp with respect to said rigid framework.

4. The limb-exercising apparatus according to claim 3, wherein said hinged ascending and descending cart ramp is operative to assume an ascended position and a descended position, wherein in said descended position said hinged ascending and descending cart ramp substantially makes contact with a substantially flat ground upon which said swivel chair is supported.

5. The-limb-exercising apparatus according to claim 4, wherein said limb-exercising apparatus keeps away from contact with said substantially flat ground in said ascended position.

6. The limb-exercising apparatus according to claim 4, wherein said hinged ascending and descending cart ramp is further operative, in said ascended position, to hold said at least one limb-exercising unit away from contact with said substantially flat ground.

7. The limb-exercising apparatus according to claim 1, wherein said at least one chair coupler is operative to keep said limb-exercising apparatus away from contact with castors of said swivel chair.

8. The limb-exercising apparatus according to claim 1, wherein said at least one limb-exercising unit is extendable and retractable position wise in relation to a position assumed by said swivel chair, such to define at least one extended position where said at least one limb-exercising unit is at a distance from said framework, and at least one retracted position where the distance between said at least one limb-exercising unit and said framework is substantially zero.

9. The limb-exercising apparatus according to claim 1, further including at least one limb-exercising unit wheel coupled with said at least one limb-exercising unit for supporting movement of respective said limb-exercising unit upon a ground.

10. The limb-exercising apparatus according to claim 1, wherein said force resistor is selected from the list consisting of:

a helical torsion spring;

a torsion spring;

a torsion bar;

a double torsion spring;

a geared resistance mechanism; and an apparatus having multiply distinct cooperating components that provide resistance in response to applied motion to at least one of said distinct cooperating components.

11. The limb-exercising apparatus according to claim 1, further comprising a force resistor adjuster that is coupled with said force resistor, said force resistor adjuster includes a plurality of settings that correspondingly determine an amount of resistance exerted by said force resistor.

12. The limb-exercising apparatus according to claim 11, further comprising a force resistor adjuster locking mechanism that is coupled with said force resistor adjustor, said force resistor locking mechanism fixes said force resistor adjuster to a particular one of said settings.

* * * * *